US009614336B2

(12) United States Patent
Los et al.

(10) Patent No.: US 9,614,336 B2
(45) Date of Patent: Apr. 4, 2017

(54) POP-UP DESKTOP RECEPTACLE

(71) Applicant: Group Dekko, Inc., Garrett, IN (US)

(72) Inventors: Andriy Los, Lviv (UA); Volodymyr Dron, Lviv (UA); Scott E. Rose, Auburn, IN (US)

(73) Assignee: Group Dekko, Inc., Garrett, IN (US)

( * ) Notice: Subject to any disclaimer, the term of this patent is extended or adjusted under 35 U.S.C. 154(b) by 0 days.

(21) Appl. No.: 14/843,566

(22) Filed: Sep. 2, 2015

(65) Prior Publication Data

US 2017/0063009 A1 Mar. 2, 2017

(51) Int. Cl.

| | |
|---|---|
| ***H01R 13/60*** | (2006.01) |
| ***H01R 27/02*** | (2006.01) |
| ***H01R 13/44*** | (2006.01) |
| ***H01R 13/73*** | (2006.01) |

(52) U.S. Cl.

CPC ..... *H01R 27/02* (2013.01); *H01R 13/44* (2013.01); *H01R 13/73* (2013.01)

(58) Field of Classification Search

CPC ..... H01R 13/44
USPC ..... 439/131, 132
See application file for complete search history.

(56) References Cited

U.S. PATENT DOCUMENTS

| | | | | |
|---|---|---|---|---|
| 3,635,174 | A | 1/1972 | Ball et al. | |
| 4,551,577 | A | 11/1985 | Byrne | |
| 4,747,788 | A | 5/1988 | Byrne | |
| 4,748,913 | A | 6/1988 | Favaretto et al. | |
| 4,984,982 | A | 1/1991 | Brownlie et al. | |
| 5,230,552 | A | 7/1993 | Schipper et al. | |
| 5,709,156 | A | 1/1998 | Gevaert et al. | |
| 5,886,295 | A | 3/1999 | Carino et al. | |
| 5,954,525 | A | 9/1999 | Siegal et al. | |
| 6,028,267 | A | 2/2000 | Byrne | |
| 6,435,106 | B2 | 8/2002 | Funk et al. | |
| 6,563,297 | B1 * | 5/2003 | Boswell | H05K 9/0007 174/375 |
| 6,942,502 | B2 * | 9/2005 | Sharples | H01R 13/44 174/480 |
| 6,979,209 | B2 * | 12/2005 | Griepentrog | H01R 13/447 174/57 |
| D526,961 | S | 8/2006 | Kissinger et al. | |
| 7,736,178 | B2 | 6/2010 | Byrne | |
| 7,871,280 | B2 | 1/2011 | Henriott | |
| 8,287,292 | B2 | 10/2012 | Byrne | |
| 8,295,036 | B2 * | 10/2012 | Byrne | G06F 1/182 174/57 |
| 8,951,054 | B2 * | 2/2015 | Byrne | H01R 13/447 307/104 |
| 2004/0147147 | A1 * | 7/2004 | Griepentrog | H01R 13/447 439/131 |

(Continued)

*Primary Examiner* — Abdullah Riyami
*Assistant Examiner* — Nader Alhawamdeh
(74) *Attorney, Agent, or Firm* — Taylor IP, P.C.

(57) ABSTRACT

A desktop receptacle includes: a housing having a top surface with a receptacle opening formed therein; an electrical receptacle including at least one electrical port and pivotally mounted within the housing adjacent to the receptacle opening, the electrical receptacle having a recessed position where the at least one electrical port is below the top surface of the housing and an exposed position where the at least one electrical port is at least partially exposed above the top surface; and a gas spring connected to the electrical receptacle so as to bias the electrical receptacle toward the exposed position.

14 Claims, 6 Drawing Sheets

(56) References Cited

U.S. PATENT DOCUMENTS

| | | | | |
|---|---|---|---|---|
| 2005/0130467 | A1* | 6/2005 | Sharples | H01R 13/44<br>439/131 |
| 2007/0159035 | A1 | 7/2007 | Mullen | |
| 2014/0120751 | A1* | 5/2014 | Senatori | G06F 1/1656<br>439/131 |

* cited by examiner

POP-UP DESKTOP RECEPTACLE

BACKGROUND OF THE INVENTION

1. Field of the Invention

The present invention relates to desktop receptacles, and, more particularly, to pop-up desktop receptacles.

2. Description of the Related Art

Desktop receptacles are commonly employed in or on work surfaces to provide data and power connections to electrical devices that are used on the work surface. Many varieties of desktop receptacle can be employed, such as pop-up receptacles. Pop-up receptacles allow a user to access the data and power connections of the desktop receptacle when needed, and then hide these connections to free up space on the work surface. One problem with many pop-up receptacles is that users often find the motion of the pop-up receptacle switching between exposed and recessed positions to be fairly rough, i.e., the motion does not feel as smooth as the user expects. To counteract the rough motion of the receptacle switching positions, dampers can be included in the receptacle, but this increases the cost of the receptacle. Further, the receptacle's components can be damaged due to wear or otherwise in a manner that does not allow the receptacle to fully switch between the exposed and recessed positions, which is aesthetically unappealing.

What is needed in the art is a desktop receptacle that can smoothly switch between the exposed and recessed positions and is less prone to wear than known receptacles.

SUMMARY OF THE INVENTION

The present invention provides a desktop receptacle with an electrical receptacle that is biased toward an exposed position by a gas spring.

The invention in one form is directed to a desktop receptacle including: a housing having a top surface with a receptacle opening formed therein; an electrical receptacle including at least one electrical port and pivotally mounted within the housing adjacent to the receptacle opening, the electrical receptacle having a recessed position where the at least one electrical port is below the top surface of the housing and an exposed position where the at least one electrical port is at least partially exposed above the top surface; and a gas spring connected to the electrical receptacle so as to bias the electrical receptacle toward the exposed position.

The invention in another form is directed to an article of furniture including: a surface having a receptacle opening formed therein; and a receptacle assembly held within the receptacle opening. The receptacle assembly includes: a housing held within the receptacle opening; an electrical receptacle including at least one electrical port and pivotally mounted within the housing adjacent to the receptacle opening, the electrical receptacle having a recessed position where the at least one electrical port is recessed behind the surface and an exposed position where the at least one electrical port is at least partially exposed past the surface; and a gas spring connected to the electrical receptacle so as to bias the electrical receptacle toward the exposed position.

An advantage of the present invention is the gas spring allows for a smooth movement of the electrical receptacle between the recessed and exposed positions without the need for dampers.

Another advantage is the gas spring is less prone to mechanical wear than traditional biasing members.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
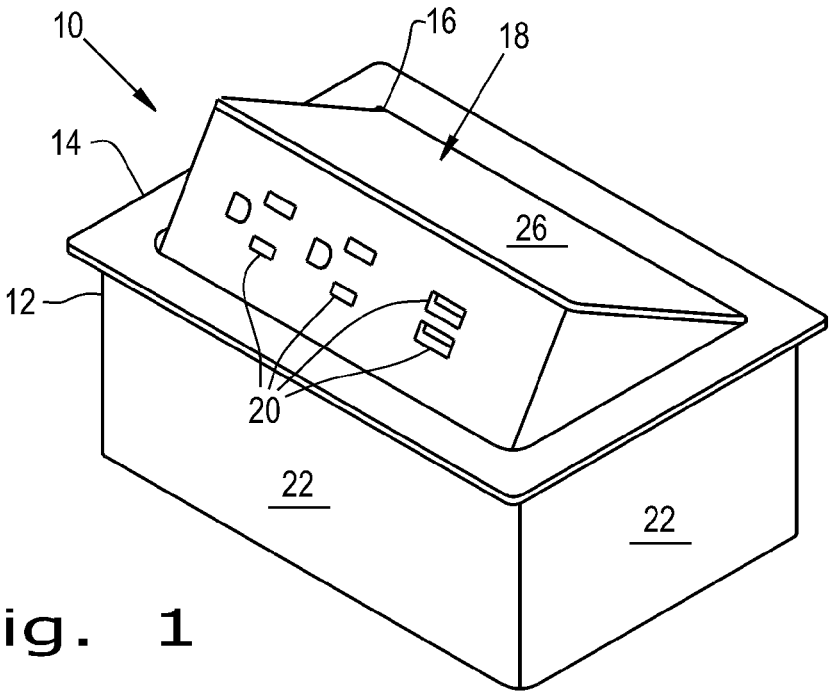
FIG. 1 is a perspective view of an embodiment of a desktop receptacle according to the present invention in an exposed position.
Figure 2:
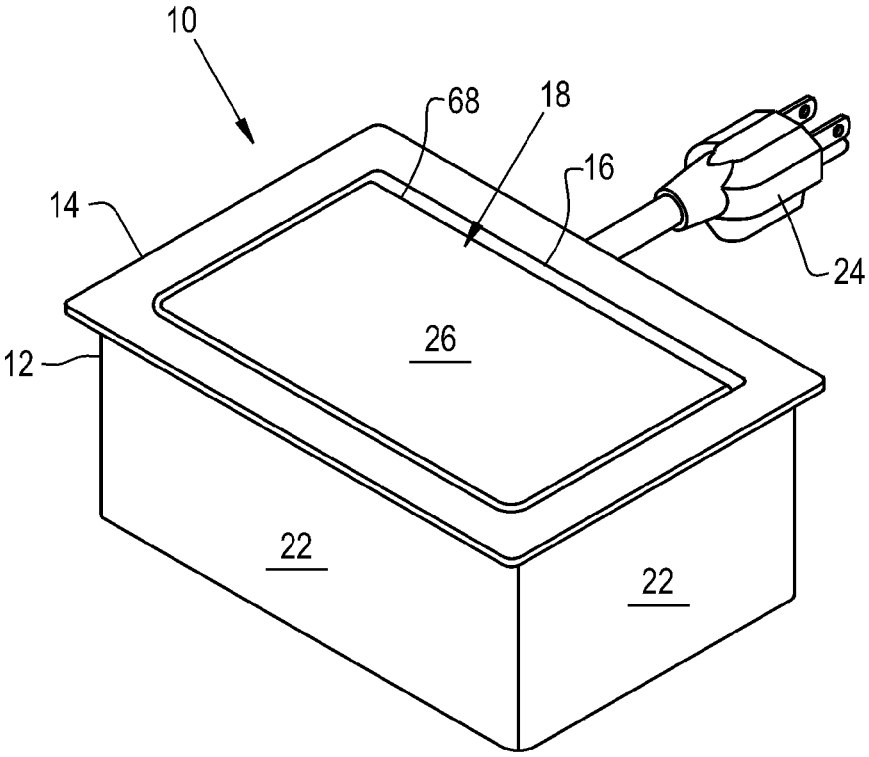
FIG. 2 is a perspective view of the desktop receptacle shown in FIG. 1 in a recessed position.

Referring now to the drawings, and more particularly to FIGS. 1-2, there is shown a desktop receptacle 10, which can also be referred to as a receptacle assembly, which generally includes a housing 12 that has a top surface 14 with a receptacle opening 16 formed therein, and an electrical receptacle 18 pivotally mounted within the housing 12 adjacent to the receptacle opening 16 so the electrical receptacle 18 can be switched between an exposed position, shown in FIG. 1, where one or more electrical ports 20, shown as four electrical ports in FIGS. 1-2, is exposed above the top surface 14 and a recessed position, shown in FIG. 2, where the electrical ports 20 are below the top surface 14. The electrical ports 20 can be formed to have any shape that allows an electrical device to be connected to a source of power and/or data. The housing 12 can include four sidewalls 22 to form a rectangular box and have the top surface 14 extend past the sidewalls 22 to form a flange that can rest on a work surface when the receptacle 10 is installed. The housing 12 can also have any necessary openings formed in the sidewalls 22 or bottom to allow for cords, such as power cord 24 shown in FIGS. 2-5, to be placed to enter and exit the receptacle 10. As shown in FIG. 2, a top 26 of the electrical receptacle 18, shown as a cosmetic cover, can be flush with the top surface 14 in the recessed position. Alternatively, the cosmetic cover 26 can rest above or below the top surface 14 in the recessed position if desired. As can be seen in comparing FIGS. 1 and 2, the electrical receptacle 18 switches between the exposed position and recessed position by pivoting through the receptacle opening 16 to either expose the electrical ports 20 past the top surface 14 or recess the electrical ports 20 behind the top surface 14. It should be appreciated that while a top surface 14 is described herein, reference to a "top surface" is used merely for convenience of description and that any surface can suffice as a "top surface."

Figure 3:
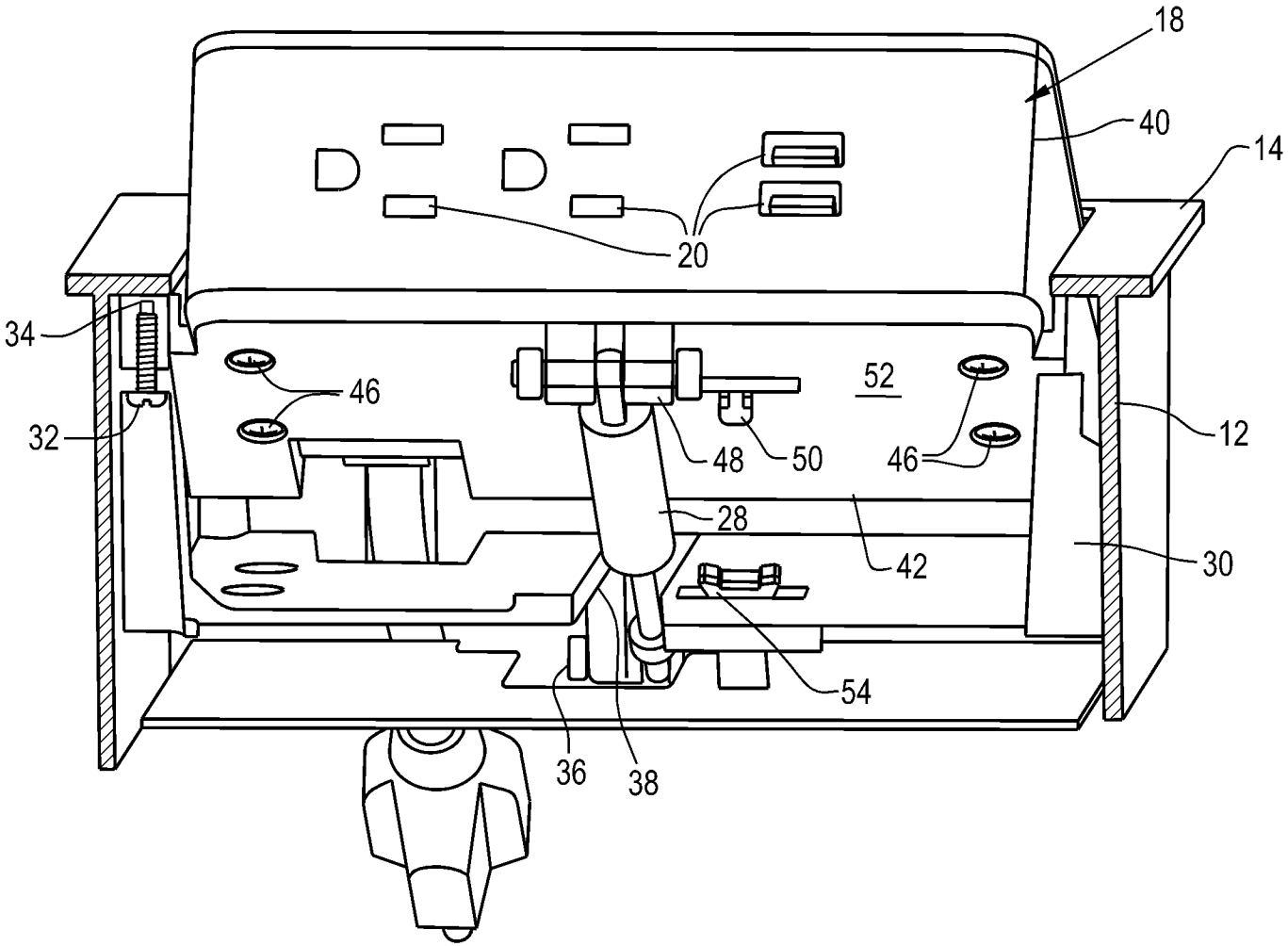
FIG. 3 is a partial cutaway view of the desktop receptacle shown in FIGS. 1-2 in the exposed position.

Referring now to FIG. 3, it can be seen that a gas spring 28 is connected to the electrical receptacle 18 so as to bias the electrical receptacle 18 toward the exposed position, i.e., the force the gas spring 28 exerts on the electrical receptacle 18 is directed toward the receptacle opening 16. Absent a counteracting force, such as a user pushing on the electrical receptacle 18, the gas spring 28 keeps the electrical receptacle 18 in the exposed position so the electrical ports 20 can be easily accessed from the work surface. Any type of gas spring 28 can be used, with gas springs 28 that can provide enough force to overcome the weight of the electrical receptacle 18 being useful.

To mount the electrical receptacle 18 and/or gas spring 28 within the housing 12, a mounting assembly 30 can be mounted to the housing 12 and connected to the electrical receptacle 18 and/or the gas spring 28. The mounting assembly 30 can have any shape that is suitably mounted to the housing 12 and can be connected to the housing 12 by, for example, screwing mounting screws 32 into threaded openings 34 of the housing 12. The mounting assembly 30 can include a spring connector 36 that connects to the gas spring 28 and a spring opening 38 that allows the gas spring 28 to pass through during expansion and contraction of the gas spring 28 as the electrical receptacle 18 switches between the exposed and recessed positions.

To assist in pivoting within the housing 12, the electrical receptacle 18 can include a main portion 40 which has the electrical ports 20 formed therein and a pivoting portion 42 that is connected to the main portion 40. The main portion 40 can be any shape and size suitable for holding electronic components, such as power circuit 44 shown in FIG. 4, to allow for electronic devices to be plugged into the power circuit 44 through the electrical ports 20 of the main portion 40. The pivoting portion 42 can be connected to the main portion 40 by, for example, screws 46 so that the main portion 40 is statically connected to the pivoting portion 42 and movement of the pivoting portion 42 carries the main portion 40 with the pivoting portion 42. The pivoting portion 42 can include a spring connector 48 that connects to the gas spring 28 to allow force from the gas spring 28 to bias the electrical receptacle 18 toward the exposed position. The pivoting portion 42 can also have a first latch feature 50 formed on a bottom 52 of the pivoting portion 42 that is aligned with a second latch feature 54 of the mounting assembly 30 so that when the electrical receptacle 18 is sufficiently pushed to push the first latch feature 50 into the second latch feature 54, a latch is formed that holds the electrical receptacle 18 in the recessed position against the force of the gas spring 28. Any type of latch features 50 and 54 can be used to form a latch that holds the electrical receptacle 18 in the recessed position, with the latch features 50 and 54 shown being part of a push-push latch that allows a user to push the features 50 and 54 together to form the latch and then further push on the electrical receptacle 18 to release the latch and allow the gas spring 28 to push the electrical receptacle 18 toward the exposed position.

Figure 4:
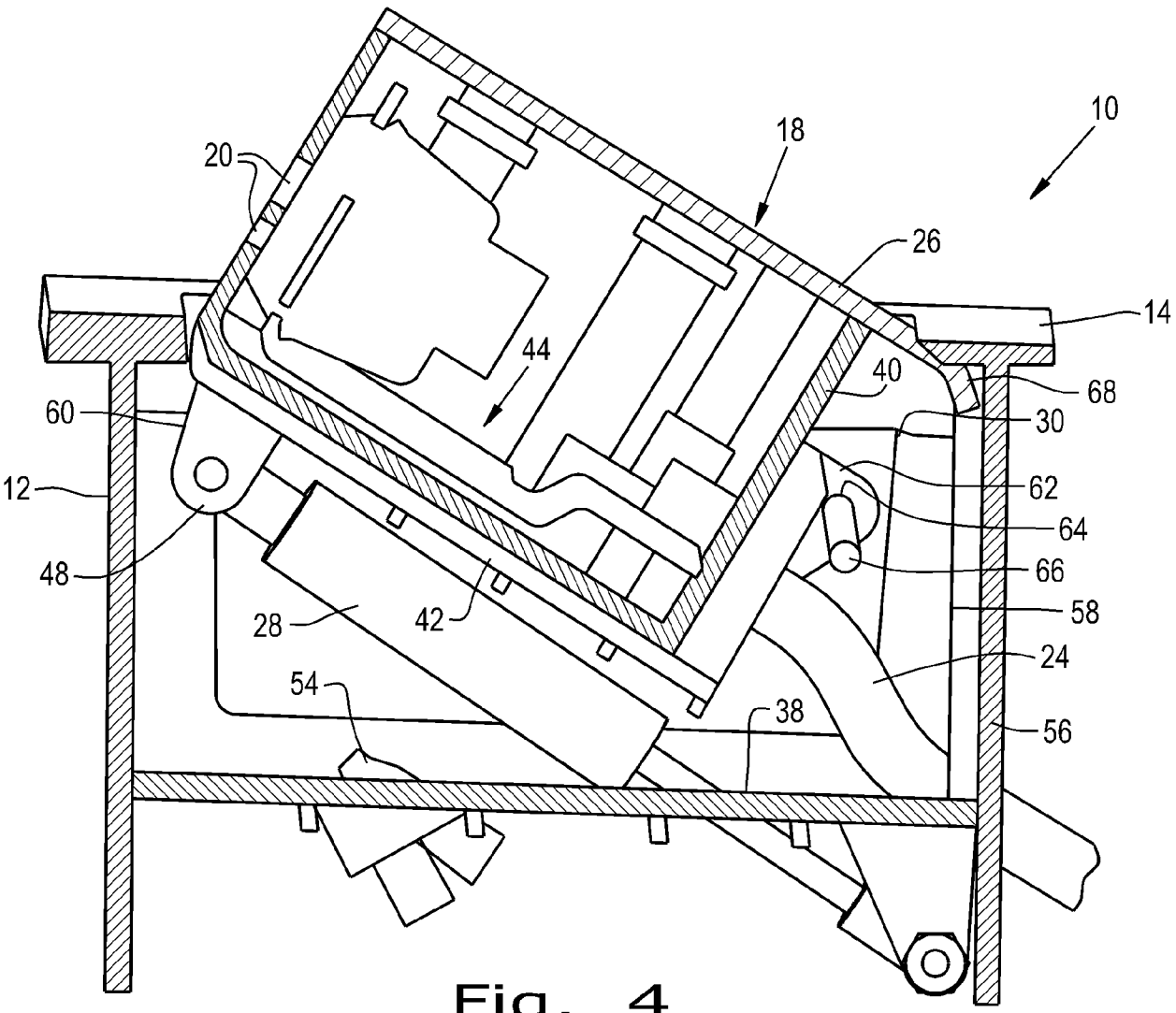
FIG. 4 is a sectional view of the desktop receptacle shown in FIGS. 1-3 in the exposed position.

Referring now to FIG. 4, a side sectional view of the receptacle assembly 10 is shown. As previously described, a power circuit 44 can be held within the main portion 40 of the electrical receptacle 18 and connect to a wall outlet via power cord 24 to provide bulk power to the power circuit 44 and any devices that are plugged into the power circuit 44 through the electrical ports 20 of the electrical receptacle 18. This allows the electrical receptacle 18 to isolate the power circuit 44 from direct exposure to a user while still allowing the user to plug electrical devices into the power circuit 44. As can be seen, the power cord 24 can exit out of the desktop receptacle 10 through an opening 56 formed in a back 58 of the mounting assembly 30 and an opening (unnumbered) formed in the housing 12. Further, the gas spring 28 can be attached to the spring connector 36 of the mounting assembly 30 adjacent to the back 58 of the mounting assembly 30 and the spring connector 48 of the pivoting portion 42 adjacent a front 60 of the pivoting portion 42. As used herein, "front" and "back" are relative orientations used only for convenience of description and not to limit the scope of the invention in any manner.

Figure 6:
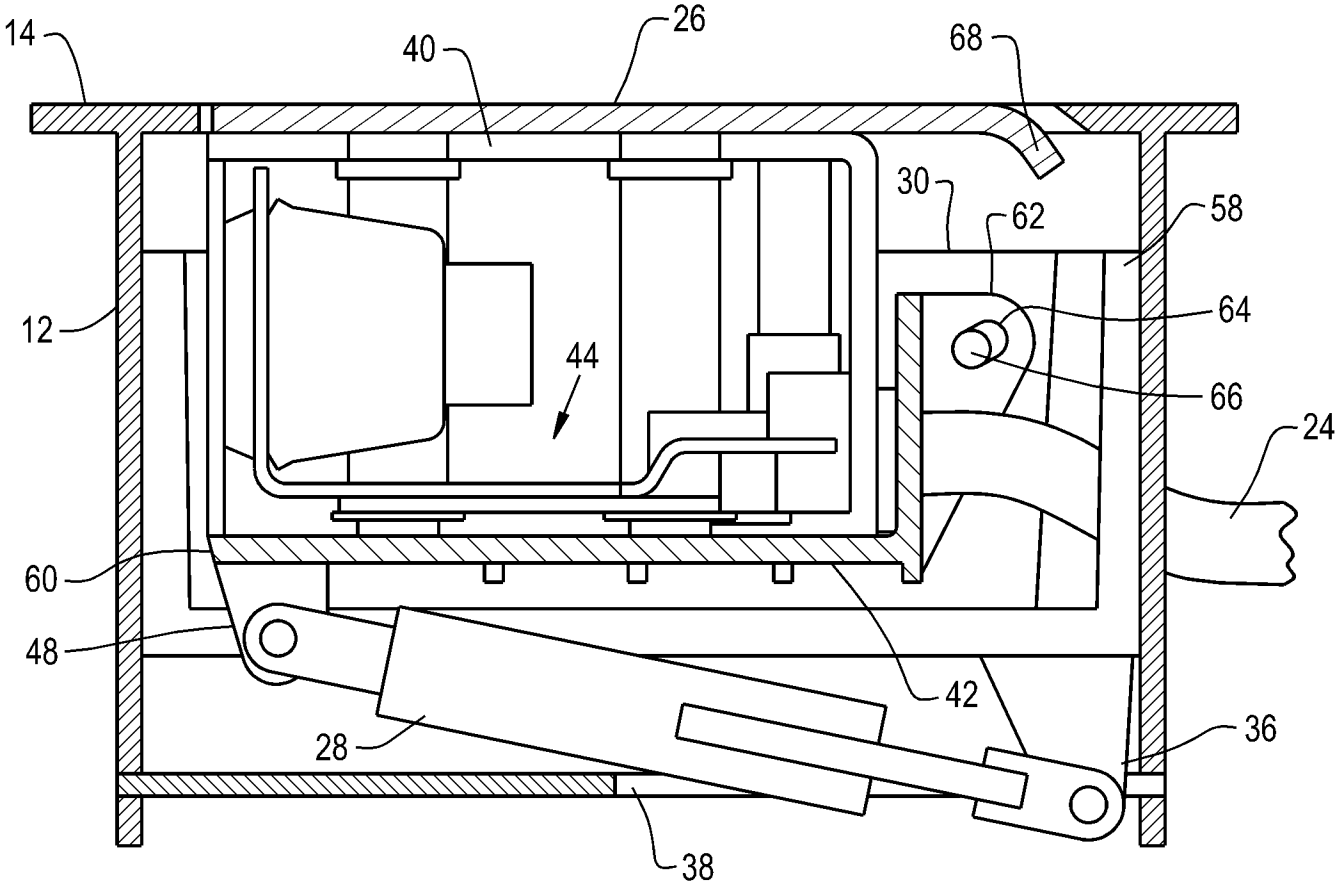
FIG. 6 is a sectional view of the desktop receptacle shown in FIGS. 1-3 in the recessed position.

To pivot between the recessed position and the exposed position, the pivoting portion 42 can have one or more pivoting tabs 62 with a pivoting opening 64 that accepts a pivot pin 66 which also extends through a mounting pivot opening (not seen) formed in the mounting assembly 30. In this sense, the pivot pin 66 defines an axis of rotation for the pivoting portion 42 that the pivoting portion 42 can pivot about when a force is applied to the electrical receptacle 18, such as the spring force provided by the gas spring 28. The cosmetic cover 26 can have a curved portion 68 defining a rear end of the cosmetic cover 26 so that as the electrical receptacle 18 pivots, the curved portion 68 will go into the housing 12 and not interfere with the pivoting of the electrical receptacle 18 through the receptacle opening 16, which can be seen in FIG. 6. Further, the curvature and length of the curved portion 68 can be adjusted to provide a stop for the electrical receptacle 18 pivoting by having the cosmetic cover 26 abut against sides of the receptacle opening 16 and/or having the curved portion 68 contact a portion of the mounting assembly 30 as the electrical receptacle 18 pivots upwardly.

Figure 5:
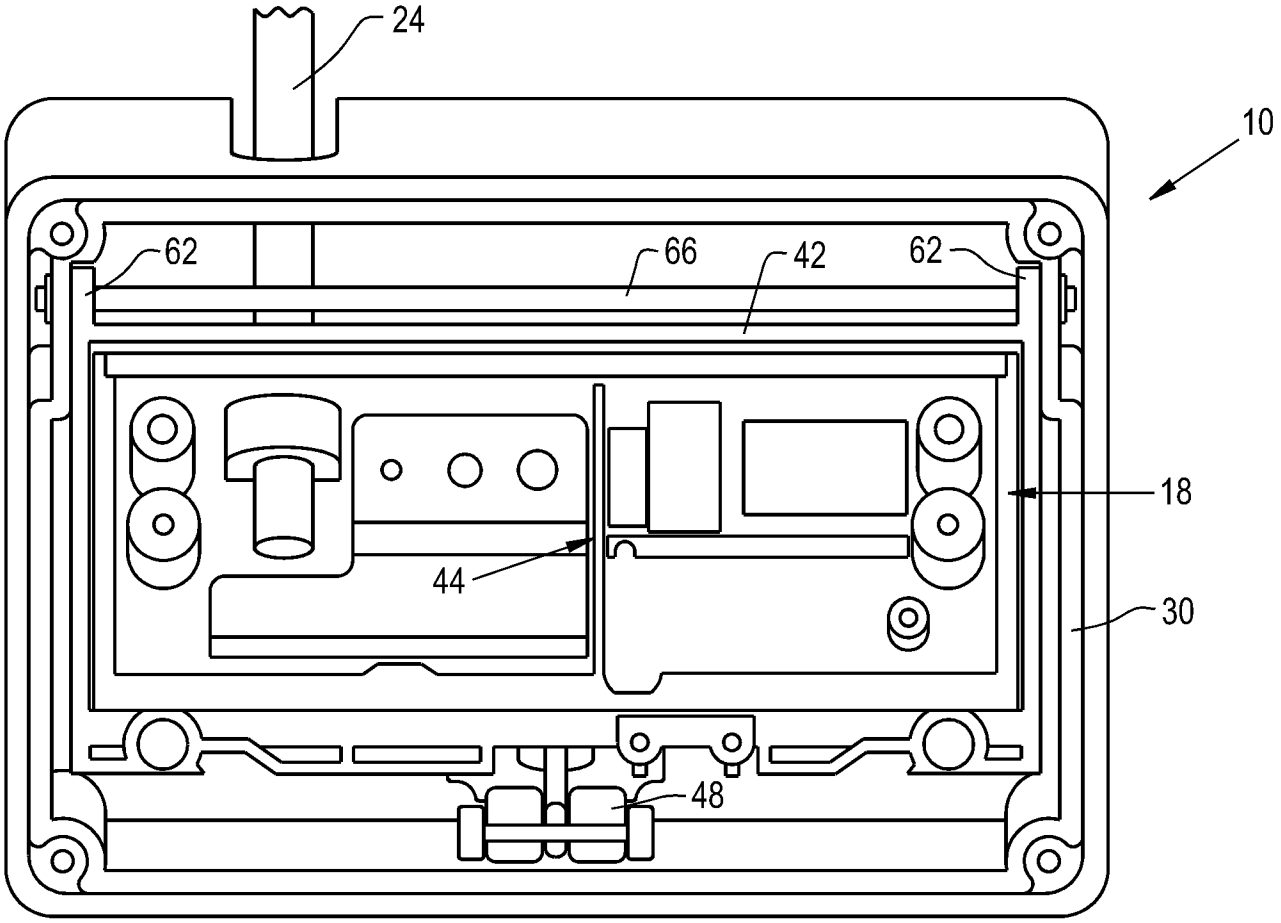
FIG. 5 is another sectional view of the desktop receptacle shown in FIGS. 1-4.

Referring now to FIG. 5, it can be seen that the pivoting portion 42 can have two pivoting tabs 62 on opposing sides of the pivoting portion 42. The mounting assembly 30 can also have two mounting pivot openings formed therein that are aligned with the pivoting openings 64 of the pivoting tabs 62 so that the pivot pin 66 can be placed through all the openings to pivotally connect the electrical receptacle 18 to the mounting assembly 30. Pivotally mounting the electrical receptacle 18 to the mounting assembly 30 within the housing 12, rather than to the housing 12 itself, allows the ends of the pivot pin 66 to be hidden from view by the housing 12 which may be more aesthetically appealing and can reduce accessibility to the pivot pin 66 to prevent tampering.

Figure 7:
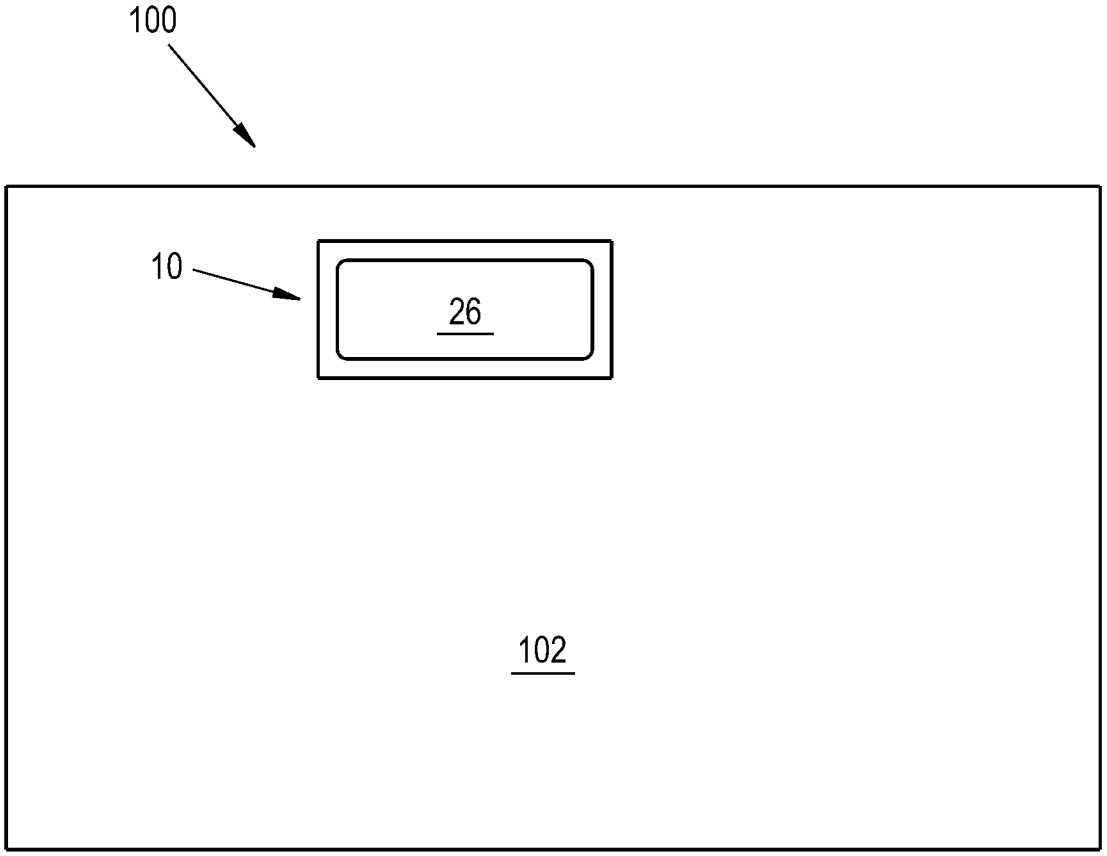
FIG. 7 is a perspective view of an embodiment of an article of furniture incorporating the desktop receptacle shown in FIGS. 1-6.

Referring now to FIG. 7, an embodiment of an article of furniture 100, shown as an office desk, according to the present invention is shown that includes the receptacle assembly 10 shown in FIGS. 1-6. As can be seen, the office desk 100 includes a surface 102 with a receptacle opening (not seen) formed therein that holds the receptacle assembly 10. Specifically, the housing 12 of the receptacle assembly 10 is held within the receptacle opening. When the receptacle assembly 10 is held in the receptacle opening of the surface 102, the electrical receptacle 18 is in the exposed position when the electrical ports 20 are exposed past the surface 102 and in the recessed position when the electrical ports 20 are recessed behind the surface 102. In this respect, the surface 102 of the office desk 100 can replace the top surface 14 of the housing 12, if desired, to allow the electrical ports 20 to either be exposed so a user can plug electrical devices into the electrical ports 20 or hidden from view by the surface 102.

When installing the receptacle assembly 10 in the article of furniture 100, it may be desired to match the appearance of the receptacle assembly 10 with the surface 102 of the furniture 100 so that the receptacle assembly 10 is not conspicuous when the electrical receptacle 18 is in the recessed position. Alternatively, it may be desired to give the receptacle assembly 10 a more aesthetically pleasing look when the electrical receptacle 18 is in the recessed position. To do this, the cosmetic cover 26 can be formed of a different material than the rest of the housing 12, such as the same material as the surface 102 of the furniture 100, so that the cosmetic cover 26 blends in with the surface 102 when the electrical receptacle 18 is in the recessed position. For example, the housing 12 and electrical receptacle 18 can be formed mostly of relatively economical polymer or other material, while the cosmetic cover 26 can be formed of a more expensive and aesthetically pleasing material such as brushed or polished metal, various types of ceramic, or natural materials such as wood. This allows the cosmetic cover 26 to give the receptacle assembly 10 an aesthetically pleasing or matching appearance with the surface 102 of the furniture 100 when the electrical receptacle 18 is in the recessed position while minimizing the amount of relatively expensive materials needed to give the receptacle assembly 10 such an appearance.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A desktop receptacle, comprising:

a housing having a top surface with a receptacle opening formed therein;

an electrical receptacle including a main portion including at least one electrical port and a pivoting portion connected to said main portion, said electrical receptacle being pivotally mounted within said housing adjacent to said receptacle opening, said electrical receptacle having a recessed position where said at least one electrical port is below said top surface of said housing and an exposed position where said at least one electrical port is at least partially exposed above said top surface, said main portion having a top which is one of parallel and coplanar with said top surface of said housing when in said recessed position and said pivoting portion having a bottom which is opposite said top of said main portion;

a mounting assembly mounted to said housing, said pivoting portion of said electrical receptacle being pivotally mounted to said mounting assembly; and a gas spring connected to said bottom of said pivoting portion of said electrical receptacle so as to bias said electrical receptacle toward said exposed position.

2. The desktop receptacle according to claim 1, wherein said pivoting portion includes a first latch feature on said bottom and said mounting assembly includes a second latch feature aligned with said first latch feature, wherein pushing said first latch feature into said second latch feature forms a latch holding said electrical receptacle in said recessed position.

3. The desktop receptacle according to claim 2, wherein said formed latch is a push-push latch.

4. The desktop receptacle according to claim 1, wherein said pivoting portion includes at least one pivoting tab having a pivoting opening and said mounting assembly includes at least one mounting pivot openings aligned with said pivoting opening, said desktop receptacle further comprising a pivot pin placed through said pivoting opening and said mounting pivot opening.

5. The desktop receptacle according to claim 1, wherein said pivoting portion defines a front, said gas spring connecting to said pivoting portion adjacent to said front.

6. The desktop receptacle according to claim 5, wherein said mounting assembly defines a back, said gas spring connecting to said mounting assembly adjacent to said back.

7. The desktop receptacle according to claim 6, wherein said mounting assembly has a spring opening formed therein that allows said gas spring to at least partially pass through as said electrical receptacle switches between said recessed position and said exposed position.

8. An article of furniture, comprising:

a surface having a receptacle opening formed therein; and a receptacle assembly held within said receptacle opening, said receptacle assembly including:

a housing held within said receptacle opening;

an electrical receptacle including a main portion including at least one electrical port and a pivoting portion connected to said main portion, said electrical receptacle being pivotally mounted within said housing adjacent to said receptacle opening, said electrical receptacle having a recessed position where said at least one electrical port is recessed behind said surface and an exposed position where said at least one electrical port is at least partially exposed past said surface, said main portion having a top which is one of parallel and coplanar with said surface when in said recessed position and said pivoting portion having a bottom which is opposite said top of said main portion;

a mounting assembly mounted to said housing, said pivoting portion of said electrical receptacle being pivotally mounted to said mounting assembly; and a gas spring connected to said bottom of said pivoting portion of said electrical receptacle so as to bias said electrical receptacle toward said exposed position.

9. The article of furniture according to claim 8, wherein said pivoting portion includes a first latch feature on said bottom and said mounting assembly includes a second latch feature aligned with said first latch feature, wherein pushing said first latch feature into said second latch feature forms a latch holding said electrical receptacle in said recessed position.

10. The article of furniture according to claim 9, wherein said formed latch is a push-push latch.

11. The article of furniture according to claim 8, wherein said pivoting portion includes at least one pivoting tab having a pivoting opening and said mounting assembly includes at least one mounting pivot openings aligned with said pivoting opening, said desktop receptacle further comprising a pivot pin placed through said pivoting opening and said mounting pivot opening.

12. The article of furniture according to claim 8, wherein said pivoting portion defines a front, said gas spring connecting to said pivoting portion adjacent to said front.

13. The article of furniture according to claim 12, wherein said mounting assembly defines a back, said gas spring connecting to said mounting assembly adjacent to said back.

14. The article of furniture according to claim 13, wherein said mounting assembly has a spring opening formed therein that allows said gas spring to at least partially pass through as said electrical receptacle switches between said recessed position and said exposed position.

* * * * *